United States Patent [19]

Hoekstra

[11] 4,353,177

[45] Oct. 12, 1982

[54] CONTROL FOR SNOWPLOW BLADE

[75] Inventor: Ralph W. Hoekstra, Stillman Valley, Ill.

[73] Assignee: Swenson Spreader Company, Lindenwood, Ill.

[21] Appl. No.: 183,283

[22] Filed: Sep. 2, 1980

[51] Int. Cl.[3] ..... E01H 5/04

[52] U.S. Cl. ..... 37/234; 200/6 A

[58] Field of Search ..... 37/41, 42 R, 42 VL, 37/50; 172/812, 819, 828, 831; 200/6 A

[56] References Cited

U.S. PATENT DOCUMENTS

| | | | |
|---|---|---|---|
| 3,585,319 | 6/1971 | Payerle et al. | 200/6 A |
| 3,770,915 | 11/1973 | Bennett et al. | 200/6 A |
| 3,814,871 | 6/1974 | Osika | 200/6 A |
| 3,824,354 | 7/1974 | Anderson et al. | 200/6 A X |
| 3,898,397 | 8/1975 | Devore et al. | 200/6 A |
| 3,927,285 | 12/1975 | Frost et al. | 200/6 A |
| 4,026,048 | 5/1977 | Hill et al. | 37/42 R |
| 4,181,827 | 1/1980 | Diepeveen | 200/6 A |
| 4,244,122 | 1/1981 | Hetrick | 37/41 |
| 4,297,542 | 10/1981 | Shumway | 200/6 A |

FOREIGN PATENT DOCUMENTS

| | | | |
|---|---|---|---|
| 2736312 | 2/1979 | Fed. Rep. of Germany | 37/41 |
| 2379852 | 10/1978 | France | 37/41 |
| 985298 | 3/1965 | United Kingdom | 200/6 A |

OTHER PUBLICATIONS

MTE, "Permanent Magnet D.C. Hydraulic Systems", brochure, 2 pages, 1978, MTE Hydraulics, Inc., Div. of Mechanical Tool & Eng. Co.

Monarch, "Wiring/Installation Instructions for the Monarch Dyna-Ramic" brochure, 6 pages, 5-1-73, Monarch Road Machinery Co.

*Primary Examiner*—E. H. Eickholt

*Attorney, Agent, or Firm*—Trexler, Bushnell & Wolters, Ltd.

[57] ABSTRACT

Control apparatus for a snowplow blade or the like, includes a control shaft movably mounted to a housing, so as to have first and second end portions extending respectively inwardly and outwardly of the housing. A control circuit is mounted in the housing and a plurality of momentary contact switches are electrically coupled with the control circuit and mounted in the housing for selective actuation by the control shaft end portion in the housing. A resilient member is in engagement with said control shaft end portion in the housing for resiliently returning the control shaft to a predetermined neutral position. The control circuit comprises solenoid control circuits for energizing a plurality of solenoids to effect movement of the snowplow blade. A first circuit portion is responsive to ones of the switches for energizing ones of the solenoids for respectively controlling the snowplow blade in left and right turning motions and in upward lifting motion. A second circuit portion is responsive to ones of the switches for energizing at least one of the solenoids for controlling downward motion of the snowplow blade. The second circuit portion also includes a timing circuit for effecting energization of the associated solenoids for a predetermined time period following actuation thereof and thereafter for de-energizing the associated solenoid.

8 Claims, 6 Drawing Figures

N.C.
N.O.

CONTROL FOR SNOWPLOW BLADE

BACKGROUND OF THE INVENTION

This invention is directed generally to control circuits for hydraulic systems and more particularly to a novel control circuit for a hydraulic system which operates a snowplow blade.

Hydraulic operating systems for vehicle-mounted snowplow blades are well known in the art. Generally, such systems comprise hydraulic pistons mounted on a snowplow blade-carrying framework for raising and lowering the snowplow blade and for angling or turning the snowplow blade left and right. These hydraulic pistons are operated by a hydraulic pump in cooperation with a number of control valves for delivering hydraulic fluid to the respective pistons for achieving the desired motion left or right and up or down. This hydraulic pump may in turn be driven by a suitable vehicle power take-off or by an electric motor.

In order to be electrically operated by a suitable control circuit, the fluid delivery control valves as well as control valves for a hydraulic power take-off, if utilized, are of the electrical solenoid-operated type. Moreover, a suitable control circuit must be provided to energize solenoid valves and an electric motor, in installations where an electric motor is utilized to drive the hydraulic pump. In either case, the control circuit operates in response to operation of a suitable manual control by the vehicle operator.

While left and right angling or turning of the snowplow blade is a relatively simple operation, additional considerations arise in the raising and lowering or up and down motion of such a snowplow blade. For example, when the vehicle is to be driven on a street or highway, the controls for the raising of the blade must reliably hold the blade in the up position at all times. On the other hand, when in use for plowing, the blade must not be rigidly held in a given position but must "float" in order to follow the contour of the surface being plowed.

The existing hydraulic solenoid valve controls commonly make use of a normally closed valve for the down or floating position of the blade. Accordingly, this valve must be constantly energized when the blade is in the down or plowing position. However, if the vehicle should be stopped for a prolonged period or left overnight with the blade in the down position, considerable power drainage from the vehicle battery will result. The prior art has not heretofore offered an adequate solution for this problem.

Moreover, it is desirable that the manual control device provided in the vehicle cab be relatively simple to operate so that the operator may devote the majority of his time to the control and operation of the vehicle.

OBJECTS AND SUMMARY OF THE INVENTION

Accordingly, it is a general object of this invention to provide a novel and improved control circuit for a hydraulically operated snowplow blade.

A more specific object is to provide such a control circuit which avoids the problems encountered with prior art devices, such as excessive battery wear experienced when the snowplow blade is left in the down position and the vehicle engine is turned off.

Yet another object is to provide a control circuit in accordance with the foregoing objects which is readily usable with existing hydraulic control systems without requiring modification thereof.

Yet another object is to provide a control circuit in accordance with the foregoing objects which is adapted to reliably hold the snowplow blade in the up or raised position rendering lowering of the blade virtually impossible during high speed vehicle travel.

A related object is to provide a novel manual control device in conjunction with a control circuit in accordance with the foregoing objects, which is relatively simple to operate, requiring but a minimum of the vehicle operator's time and concentration.

BRIEF DESCRIPTION OF THE DRAWINGS

Other objects, features and advantages of the invention will be more readily appreciated upon reading the following detailed description of the illustrated embodiment, together with reference to the accompanying drawings wherein.

DETAILED DESCRIPTION OF THE ILLUSTRATED EMBODIMENT

Figures 1, 2, 3, 4:
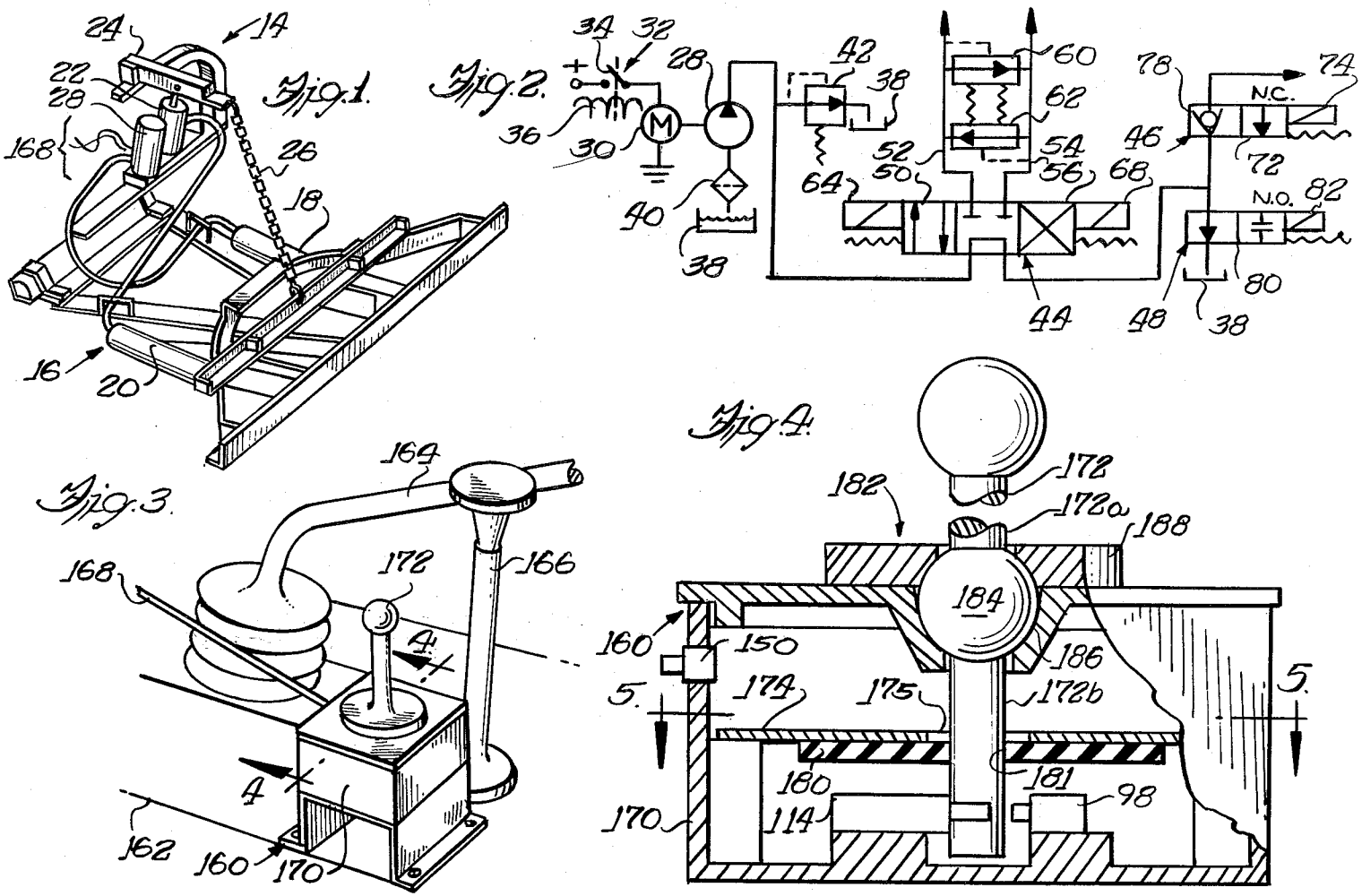
FIG. 1 illustrates a typical assembly for mounting a snowplow blade to a vehicle, including a typical hydraulic control system.
FIG. 2 is a schematic diagram of the hydraulic control system utilized in conjunction with the snowplow blades of FIG. 1.
FIG. 3 is a perspective view of a vehicle cab-mounted manual control apparatus in accordance with the present invention.
FIG. 4 is an enlarged view taken generally along the line 4—4 of FIG. 3.

Referring now to the drawings, and initially to FIG. 1, a typical snowplow blade, designated generally by the reference numeral 10, is mountable to a vehicle (not shown). A suitable frame, designated generally by the reference numeral 14, is employed on the vehicle for receiving a cooperating frame, designated generally by the reference numeral 16, which carries the snowplow blade 10. This frame 16 also carries hydraulic operating equipment for angling the blade 10 respectively right and left as well as for raising and lowering the blade 10.

Briefly, the hydraulic operating devices mounted to the frame 16 include a pair of hydraulic pistons-and-cylinders 18 and 20 for angling the blade left and right. A similar hydraulic piston-and-cylinder 22 is mounted to the vehicle-carried frame 14 and is provided with a suitable lever arm 24 and a chain 26 or other suitable connecting members to a forward portion of the frame 16 for raising and lowering the snowplow blade 10. A hydraulic pump 28 delivers hydraulic fluid under pressure to the respective pistons 18, 20 and 22, by way of suitable control valves which will be discussed hereinbelow, to achieve the desired motion of the blade 10. This hydraulic pump 28 is driven by a suitable electric motor (FIG. 2) in the illustrated embodiment, but may also be driven by a suitable power take-off (not shown) from the vehicle 12.

Reference is next invited to FIG. 2 wherein a typical hydraulic control system for the pistons 18, 20 and 22 and hydraulic pump 28 of FIG. 1 is diagrammatically illustrated. In the illustrated embodiment, the pump 28 is driven by an electrical motor 30 although the present invention may also be readily utilized with a hydraulic power take-off arrangement from the vehicle, as mentioned above.

The motor 30 is in turn energized by a suitable electrical solenoid control switch, designated generally by the reference numeral 32, and which includes a movable contact 34, operated by a solenoid coil 36, to deliver electrical energy from a suitable positive voltage source such as the vehicle battery. A supply of suitable hydraulic fluid is supplied to the pump 28 from a reservoir 38 by way of a suitable filter 40. A suitable pressure relief valve 42 is also provided for the pump 28 to return hydraulic fluid to the reservoir 38, should the pump 28 exceed a predetermined maximum or relief pressure.

The pump 28 feeds a solenoid operated valve, designated generally by the reference numeral 44, for alternatively delivering fluid to cylinders 18 and 20 for achieving left and right angling motion of the blade 10. The pump 28 also feeds solenoid-operated control valves 46 and 48 which alternatively feed or drain hydraulic fluid from the cylinder 22 for achieving raising and lowering of the blade 10.

The solenoid-operated valve 44 includes a first portion 50 which, when energized, delivers hydraulic fluid to a first branch 52 and drains fluid from a second branch 54. A second valve portion 56, when energized, reverses this flow, delivering fluid to the branch 54 and draining fluid from the branch 52. These branches 52 and 54 respectively feed the cylinders 18 and 20 for achieving left and right angling motion of the blade 10.

The branches 52 and 54 are further equipped with suitable pressure relief valves 60 and 62 for pressure relief should either branch 52 or 54 exceed a predetermined maximum fluid pressure.

An electrically operated solenoid control member 64 including a coil 66 (FIG. 6) is associated with the valve portion 50. A similar electrical solenoid control member 68 and associated coil 70 (FIG. 6) are associated with the valve portion 56.

Figure 6:
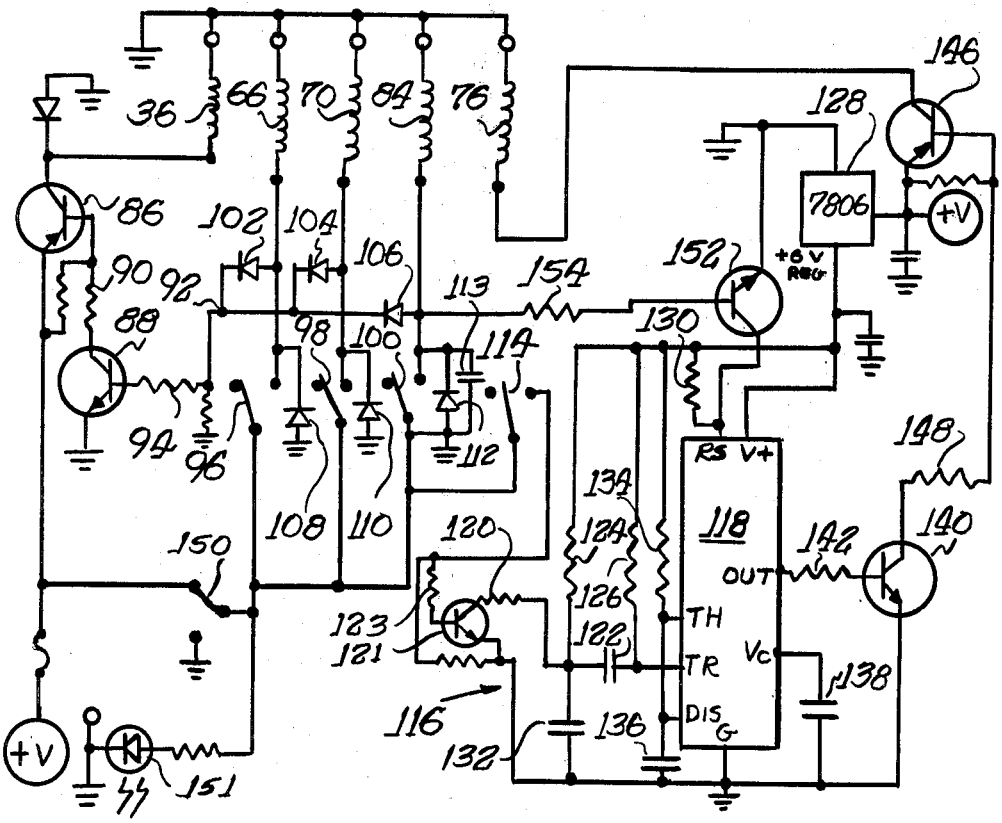
FIG. 6 is a schematic diagram of a novel control circuit in accordance with the present invention.

Referring now to control valve 46, a normally closed valve portion 72 is operated by a further electrical solenoid control member 74 which is actuated by its coil 76 (FIG. 6). A ball valve portion 78 is also provided in the control valve assembly 46. Similarly, the control valve 48 includes a normally open valve portion 80 operated by an electrical solenoid control member 82 and associated coil 84 (FIG. 6). From the foregoing, it will be appreciated that with normally open valve 80 de-energized, fluid will be returned to the reservoir 38, and the blade 10 cannot be raised. However, upon energization of the coil 84 the normally open valve 80 will close, resulting in the delivery of hydraulic fluid through ball valve 78 to cylinder 22 to effect raising of blade 10. Upon energization of coil 76, however, the normally closed valve 72 will open, and if coil 84 is de-energized, valves 72 and 80 will both remain open, thereby allowing the blade 10 to be lowered, and to substantially "float", following the ground contour.

Reference is next invited to FIG. 6, wherein a novel control circuit for selectively energizing the solenoid coils 36, 66, 70, 76 and 84 of FIG. 3 is illustrated. The solenoid coils 36, 66, 70, 76 and 84 each have one terminal tied to ground. The remaining terminal of solenoid 36 is energized from the collector electrode of PNP transistor 86 whose emitter electrode is tied to a positive voltage supply (e.g. the vehicle battery). The base electrode of the transistor 86 is fed from the collector electrode of an NPN transistor 88 through a suitable resistor 90. The emitter of transistor 88 is tied to ground and the base electrode thereof is energized from a line 92 by way of a suitable resistor 94. The line 92 is energized by operation of any one of three switches 96, 98 and 100 by way of respective series-connected diodes 102, 104 and 106. The switches 96, 98 and 100 are for control of left and right angling and of raising of the blade 10, respectively, as will be more fully discussed hereinbelow. In operation, the transistors 88 and 86 provide a relatively high current required for operation of solenoid coil 36 for energizing the motor 30, without passing such current through the switches 96, 98 and 100, thereby substantially lessening the current carrying requirement of these switches. In the preferred embodiment, the transistor 86 may be of the type generally designated TIP 145 while the transistor 88 may be of the type generally designated 2N2222.

Each of coils 66, 70 and 84 is provided with a suitable diode 108, 110, 112 for "spiking" to protect the transistors 88 and 152 during switching, the anode electrode of each diode being coupled with ground. Accordingly, the normally open terminal of switch 96, together with the cathode of diode 108 is tied to the remaining side of solenoid coil 66. In similar fashion, switches 98 and 100 and diodes 110 and 112 as well as a capacitor 113 are provided for the respective solenoid coils 70, 84. A remaining control switch 114 is designated as the down control switch, for lowering the snowplow blade to achieve the "float" position discussed above. This switch 114 is part of a novel control circuit 116 for selectively energizing the solenoid coil 76.

Accordingly, operation of any of the switches 96, 98 or 100 energizes the motor 30 by way of the solenoid coil 36, to start the pump 28 for delivering hydraulic fluid to the hydraulic control valves 44, 46 and 48, for achieving the desired motion of the blade left, right or up. However, each switch 96, 98 and 100 is required only to carry current sufficient for operation of its associated solenoid coil 66, 70, 84, the current requirements of the solenoid coil 36 for the motor 30 being handled by the transistor 86.

In accordance with a feature of the invention, this control circuit 116 includes an integrated circuit timer 118, which in the illustrated embodiment is of the type generally designated 555.

This timer circuit 118 receives a triggering pulse at a trigger terminal TR from a series-connected resistor 120 and capacitor 122. This triggering pulse is received from a transistor 121 to the TR terminal when the movable contactor of the switch 114 is actuated into contact with the free end of a resistor 123 in series with the base electrode of the transistor 121, whose emitter electrode is grounded. This movable contactor switch 114 is in common with switches 96, 98 and 100. A suitable biasing voltage is provided at either end of capacitor 122 by way of suitable resistors 124 and 126, which receive a regulated DC voltage from a voltage regulator integrated circuit 128. In the illustrated embodiment this voltage regulator circuit 128 comprises an integrated circuit of the type generally designated 7806. The regulator 128 also feeds a regulated DC voltage to the positive voltage supply terminal V+ of the timer circuit 118 and also to the reset terminal RS thereof by way of a suitable resistor 130. A capacitor 132 is connected from the junction of resistor 124 with capacitor 122 to ground.

The timing circuit 118 also includes a timing terminal TH and a discharge terminal DIS which are joined in common with a junction between a timing resistor 134 and a timing capacitor 136. This resistor 134 and capacitor 136 are joined in series between the regulated voltage supply line from regulator 128 and ground. The timer circuit 118 also includes a ground terminal G which is joined directly to ground and a reference voltage terminal Vc which is joined to ground by way of a capacitor 138.

An output terminal OUT, of the timer circuit 118 feeds the base electrode of an NPN transistor 140 via a resistor 142, the emitter electrode of transistor 140 being tied to ground. The collector electrode of transistor 140 is joined to the base electrode of a PNP transistor 146 by a resistor 148. The emitter electrode of this latter transistor 146 is joined to the positive voltage supply while the collector electrode thereof feeds the remaining end of solenoid coil 76.

In accordance with a feature of the invention, a manually operable switch 150 is interposed in the line joining the switches 96, 98, 100 and 114 with the positive voltage supply (e.g. the vehicle battery). An on-off indicator such as an LED 151 may be provided at the switch 150.

In operation, the output terminal of the timer circuit 118 is normally in a low state or substantially at circuit ground. Accordingly, the transistor 140 passes substantially no collector-emitter current, so that transistor 146 remains effectively closed to the passage of current through solenoid coil 76. Actuation of the blade down control switch 114 to the free end of resistor 120 results in a trigger pulse to the timer circuit 118. This trigger pulse causes the output terminal OUT to go high and remain high for a time period determined by the choice of values of the timing resistor 134 and of the timing capacitor 136. With the output terminal OUT of timing circuit in the high state, that is substantially at the regulated supply voltage, transistor 140 sinks current from the base electrode of transistor 146, whereby transistor 146 becomes substantially open allowing current to flow through and energize the solenoid coil 76. The foregoing assumes that switch 150 is closed so as to energize the switches 96, 98, 100 and 114.

It will be remembered from the discussion of FIG. 3 that energization of coil 76 opens suitable hydraulic valves for allowing the snowplow blade to be in the free or "floating" position, thereby to substantially follow the ground contour during plowing. Advantageously, when the timing circuit 118 reaches the time determined by resistor 134 and capacitor 136, the output terminal again goes low or substantially to circuit ground, again stopping flow of current through solenoid 76.

In normal plowing operation, the blade is generally left in the down or floating position for no more than a few minutes at any given time. Accordingly, the choice of resistor 134 and capacitor 136 will permit a maximum time for blade operation in this floating position, thereafter shutting off current to avoid the draining of the vehicle battery, for example if the vehicle should be turned off and left for a protracted period. In the illustrated embodiment, the resistor 134 and capacitor 136 were chosen at 18 Megaohms and 15 Microfarads, respectively, thereby establishing substantially a five-minute timing period for the timing circuit 118. Other values can be readily chosen by those skilled in the art for a particular application, without departing from the principles of the invention.

The circuit of FIG. 7 also provide for interruption of the operation of the timing circuit upon operation of the up control switch 100. When the up control switch 100 is moved to its closed position for lifting the blade, the reset terminal RS of timing circuit 118 is energized, thereby effectively driving the output terminal OUT to ground and de-energizing the solenoid coil 76. This reset terminal RS feeds the collector electrode of an NPN transistor 152 whose emitter terminal is grounded and whose base terminal is joined in series with a resistor 154 to the junction of the normally opened terminal of switch 100 with the solenoid coil 84. Thus, momentary actuation of the switch 100 produces a logic zero or ground pulse on reset terminal RS.

Figure 5:
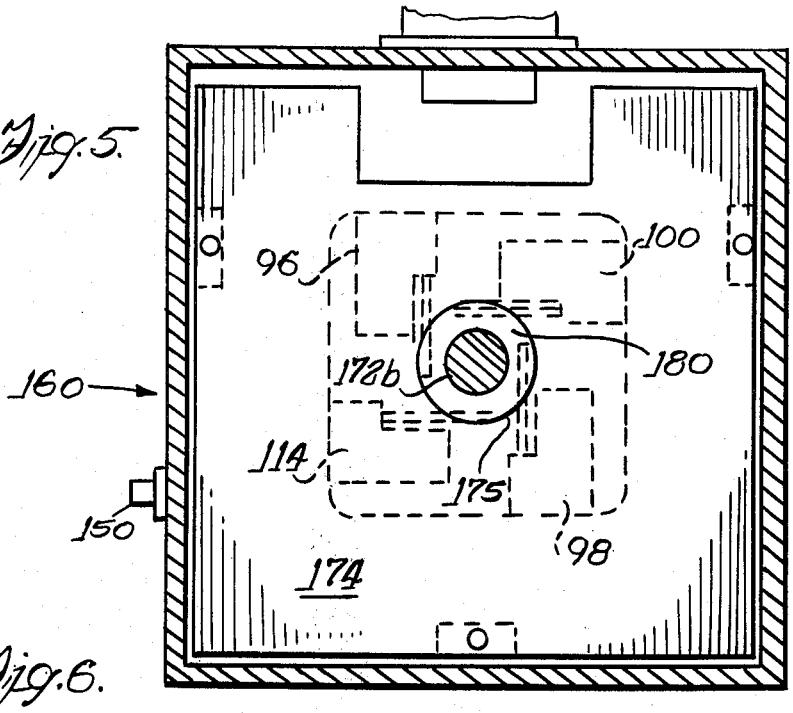
FIG. 5 is an enlarged sectional view taken generally along the line 5—5 of FIG. 4.

Referring now to FIGS. 3, 4 and 5, the novel operator accessible manual control apparatus of the invention is designated generally by the reference numeral 160. In FIG. 4, the manual control apparatus 160 is shown mounted for convenient operation by the driver of vehicle 12 on a transmission hump 162 of the vehicle, adjacent a gear shift lever 164 and 4-wheel drive control lever 166. A suitable electrical cable designated generally by the reference numeral 168 feeds the control apparatus of FIG. 3 which is mounted adjacent the pump 28 of FIG. 2. As seen in FIG. 4, the control apparatus 160 includes a housing 170 and a control lever 172.

Referring now to FIGS. 5 and 6, the housing 170 mounts the on-off switch 150, and a circuit board 174 for carrying the other circuit components of FIG. 7. The solenoid coils 36, 66, 70, 76 and 84 are a part of the hydraulic control apparatus in FIG. 3 and are mounted adjacent the pump 28 of FIG. 2. As viewed in FIG. 5, the circuit board 174 is substantially centrally mounted in the housing 170. The switches 96, 98, 100 and 114 are mounted at a bottom portion of housing 170 for individual actuation in response to movement of control lever 172. Advantageously, the control lever 172 includes a first shaft portion **172*a* extending externally of the housing 170 for manual operation and a second shaft portion 172*b* extending internally of the housing 170 for actuation of the switches 96, 98, 100 and 114 which, in accordance with a further feature of the invention, are all of the momentary contact type. Advantageously, the shaft portion 172*b* is grippingly engaged by a sheet of elastomeric material 180, which may be of rubber or like material, which is attached to the underside of the circuit board 174. An opening 181 through the elastomeric material 180 grippingly engages the shaft portion 172*b*. A similar opening 175 in the circuit board 174 is of substantially greater area than the opening 181 and thereby permits passage of shaft portion 170*b*** therethrough without interference.

In cooperation with the elastomeric sheet 180, a ball joint, designated generally by the reference numeral 182 is provided for joining the control lever 172 to the top portion of the housing 170. This ball joint 182 includes a ball member 184 in engagement with the control lever 172, a ball receiving chamber 186 formed substantially centrally in the top portion of the housing 170 and a cover plate 188, which cooperates with the ball receiving portion 186 to receive ball 184, thereby completing ball joint 182.

From the foregoing, it will be appreciated that movement by the operator of control lever 172 may effect contact of the shaft end portion **172*b* thereof with any one of control switches 96, 98, 100 or 114. However, upon release by the operator, control lever 172 returns to its upright position, thereby releasing portion 172*b*** thereof from contact with any switch, due to the action of elastomeric material 180 in cooperation with the ball joint 182. To this end, the switches 96, 98, 100 and 114 are arrayed with their movable contacts defining substantially a rectangle or square about the shaft end portion 172*b* of the control lever 172.

Suitable indicia (not shown) may be superimposed upon the top portion of housing 170 to indicate to the operator the desired control shaft movement for effecting operating of the blade in the desired fashion: to angle the blade left or right, or to raise or lower the blade. Consequently, the amount of left or right angler movement as well as the degree of raising blade 10 may be controlled by the operator by visually observing blade 10 as pressure is applied to the to the control lever 172.

While the present invention has been described and illustrated herein in conjunction with a preferred embodiment, the invention is not limited thereto. On the contrary, changes, alternatives and modifications may become apparent to those skilled in the art. The present invention includes such changes, alternatives and modifications insofar as they fall within the spirit and scope of the appended claims.

The invention is claimed as follows:

1. Control apparatus for a snowplow blade or the like, comprising: a housing, a control shaft, means forming a joint for movably mounting said control shaft to said housing, said control shaft having first and second end portions extending respectively inwardly and outwardly of said housing, a control circuit, means in said housing for mounting said control circuit, switch means electrically coupled with said control circuit and mounted in said housing for selective actuation by said first control shaft end portion and resilient means in engagement with said first control shaft end portion for resiliently returning said control shaft to a predetermined neutral position, wherein said resilient means comprises a sheet of elastomeric material having a through opening grippingly engaging said control shaft and wherein said means for mounting said control circuit comprises a circuit board mounted in said housing intermediate said means forming a joint and said resilient means and having a through opening in registry with said sheet through opening but of substantially greater area so as not to engage said control shaft.

2. Apparatus according to claim 1 wherein said switch means comprises a plurality of momentary contact-type electrical switches arranged in said housing so as to be individually selectively actuatable by said first control shaft end portion.

3. Apparatus according to claim 2 wherein said plurality of switches are four in number and arranged so as to bound the sides of a rectangle, said first control shaft end portion being substantially centered in said rectangle when in said predetermined neutral position and movable from said neutral position for actuation of any one of said electrical switches.

4. Apparatus according to claim 1 or claim 3 wherein said means forming a joint comprises a ball joint.

5. Apparatus according to claim 1 wherein said resilient means is carried by one side of said circuit board.

6. Apparatus according to claim 1 wherein said control circuit comprises solenoid control circuits for energizing a plurality of solenoids to effect movement of said snowplow blade, a first circuit portion responsive to said switch means for energizing ones of said plurality of solenoids for respectively controlling the snowplow blade in left and right turning motions and in upward lifting motion, and a second circuit portion responsive to said switch means for energizing at least one of said plurality of solenoids for controlling downward motion of the snowplow blade, said second circuit portion further including timing means for effecting energization of said at least one of said plurality of solenoids for a predetermined time period following actuation thereof and thereafter for de-energizing at least one solenoid.

7. Control apparatus for a snowplow blade or the like, comprising: a housing, a control shaft, means forming a ball joint for movably mounting said control shaft to said housing, said control shaft having first and second end portions extending respectively inwardly and outwardly of said housing, a control circuit, means in said housing for mounting said control circuit, a plurality of momentary contact switches electrically coupled with said control circuit and mounted in said housing for selective actuation by said first control shaft end portion and resilient means in engagement with said first control shaft end portion for resiliently returning said control shaft to a predetermined neutral position and thereby providing momentary contact between said control shaft and said momentary contact switches, wherein said resilient means comprises a sheet of elastomeric material having a through opening grippingly engaging said control shaft and wherein said means for mounting said control circuit comprises a circuit board mounted in said housing intermediate said means forming a joint and said resilient means and having a through opening in registry with said sheet through opening but of substantially greater area so as not to engage said control shaft.

8. Apparatus according to claim 7 wherein said plurality of switches are four in number and arranged so as to bound the sides of a rectangle, said first control shaft end portion being substantially centered in said rectangle when in said predetermined neutral position and movable from said neutral position for actuation of any one of said electrical switches.

* * * * *